US008223999B2

(12) United States Patent
Dunn

(10) Patent No.: US 8,223,999 B2
(45) Date of Patent: Jul. 17, 2012

(54) SPEAKER CONFIGURATION

(75) Inventor: William Dunn, Alpharetta, GA (US)

(73) Assignee: Manufacturing Resources International, Inc., Alpharetta, GA (US)

( * ) Notice: Subject to any disclaimer, the term of this patent is extended or adjusted under 35 U.S.C. 154(b) by 712 days.

(21) Appl. No.: 12/266,233

(22) Filed: Nov. 6, 2008

(65) Prior Publication Data

US 2009/0252354 A1 Oct. 8, 2009

Related U.S. Application Data

(60) Provisional application No. 61/041,796, filed on Apr. 2, 2008.

(51) Int. Cl.
*H04R 5/02* (2006.01)
*H04R 1/02* (2006.01)

(52) U.S. Cl. ..... 381/300; 381/1; 381/87; 381/303; 381/305; 381/332

(58) Field of Classification Search ..... 381/24, 381/300, 303–306, 386, 87, 332
See application file for complete search history.

(56) References Cited

U.S. PATENT DOCUMENTS

| | | | | |
|---|---|---|---|---|
| 3,674,108 | A * | 7/1972 | Beatty | 181/149 |
| 4,574,906 | A * | 3/1986 | White et al. | 181/145 |
| D373,120 | S | 8/1996 | Andre et al. | |
| 5,970,161 | A * | 10/1999 | Takashima et al. | 381/386 |
| D530,686 | S | 10/2006 | Reza | |
| 2005/0031144 | A1* | 2/2005 | Mizuno et al. | 381/306 |
| 2005/0071252 | A1* | 3/2005 | Henning et al. | 705/26 |
| 2005/0127796 | A1* | 6/2005 | Olesen et al. | 312/7.2 |
| 2005/0202879 | A1* | 9/2005 | Hussaini et al. | 463/47 |

* cited by examiner

*Primary Examiner* — Lynne Gurley
*Assistant Examiner* — Galina Yushina
(74) *Attorney, Agent, or Firm* — Standley Law Group LLP

(57) ABSTRACT

A system and method for speaker configuration in an audio and video housing, wherein the audio and video housing may be supported by stands located on top of a gas pump. The audio and video housing may have an audio and video source, at least one video display, and circuitry to drive the pair of speakers. The speakers may have a covering to provide protection from moisture and foreign particles. The speakers may be positioned to output sound downward directed towards the top of a gas pump. The sound may then be redirected to a first and second listening area.

18 Claims, 4 Drawing Sheets

SPEAKER CONFIGURATION

CROSS-REFERENCE TO RELATED APPLICATIONS

This application is a non-provisional patent application and claims priority to U.S. Provisional Application No. 61/041,796 filed Apr. 2, 2008, which is hereby incorporated by reference as if fully rewritten herein.

TECHNICAL FIELD

Example embodiments relate to a speaker configuration for audio and video displays for gas pumps. More particularly, specific embodiments relate to a speaker configuration for audio and video displays at gas pumps providing stereo sound to two listening areas.

BACKGROUND AND SUMMARY OF THE INVENTION

Currently some gas pumps provide multimedia displays having an audio and video output. As space is at a premium in such multimedia displays, little attention has been paid to the quality of sound produced. Exemplary embodiments of the speaker configuration may allow the multimedia displays to provide high quality stereo sound to two listening areas while saving space over current designs. In addition, exemplary embodiments may also provide protection for the speakers against moisture and foreign particles that may damage the speakers.

Exemplary embodiments may provide a speaker configuration for audio and video housings at gas pumps. The configurations of the exemplary embodiments may provide high quality stereo sound to two listening areas adjacent to the audio and video housing. One such exemplary embodiment provides an audio and video housing, supported by at least one stand, located on top of a gas pump. The audio and video housing may contain a pair of speakers positioned to direct the sound output in a downward direction. The sound may then be redirected to the two listening areas. In another exemplary embodiment, covers may be placed over the speakers to provide additional protection from the elements.

Audio and video housings having exemplary embodiments of the speaker configuration may be retrofit to existing gas pumps or integrated into newly constructed gas pumps. The ability to retrofit existing gas pumps provides a low cost way to provide multimedia displays without the need to replace existing gas pumps. In addition, the ability to integrate the audio and video housing into newly constructed gas pumps eliminates the need for a multi-step installation of the audio and video housing.

Other systems, methods, features and advantages of the invention are, or will become apparent to one skilled in the art upon examination of the following figures and detailed description. It is intended that all such additional systems, methods, features, and advantages be included within this description and within the scope of the invention.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE EXEMPLARY EMBODIMENT(S)

Figure 1:
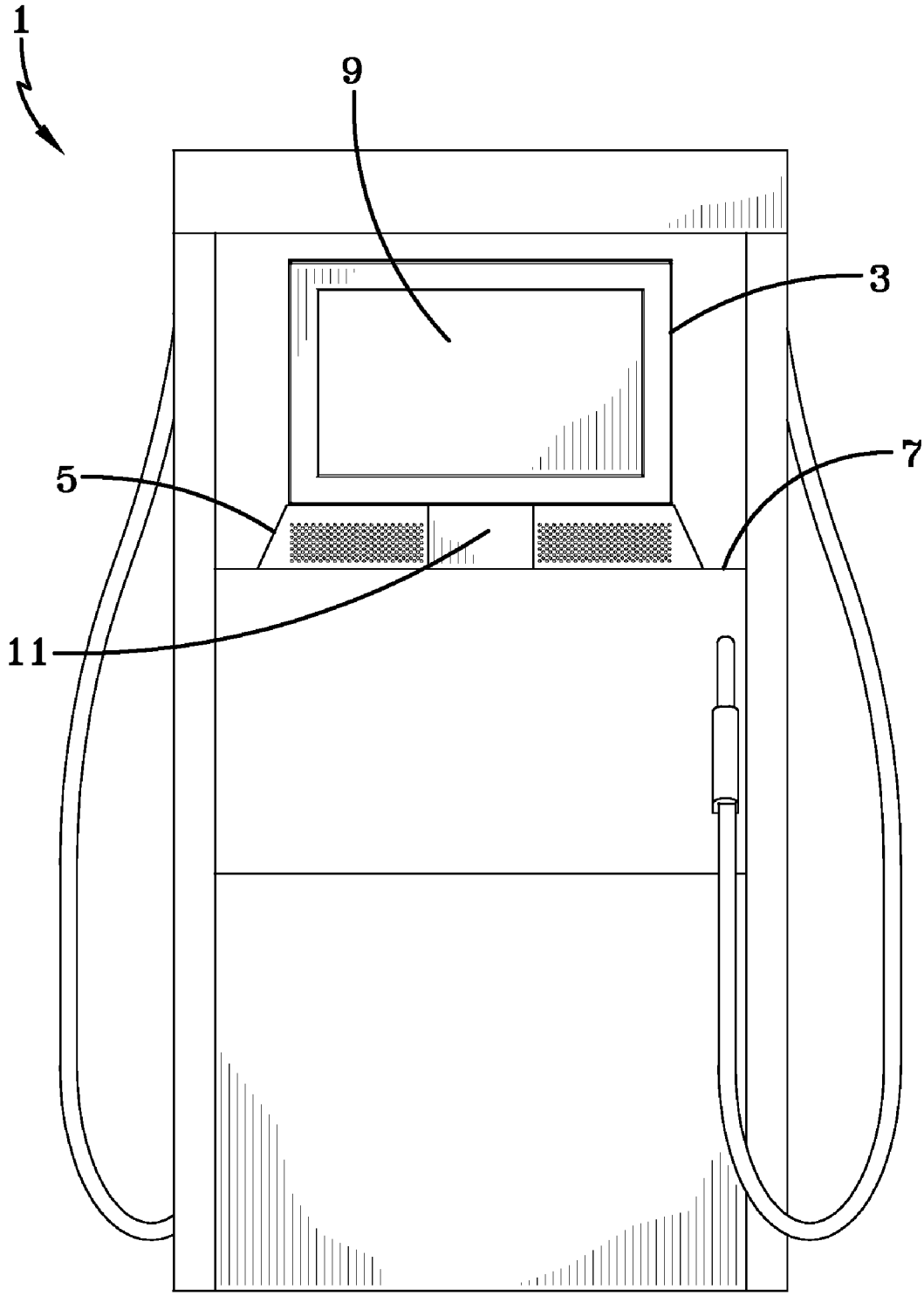
FIG. 1 is a front view of a gas pump having an audio and video housing with an exemplary embodiment of the speaker configuration.

FIG. 1 is a front view of a gas pump 1 having an audio and video housing 3 located on at least one stand 5. The at least one stand 5 may support the audio and video housing 3 on a top surface 7 of the gas pump 1 and may provide a support 11 between the bottom of the audio and video housing 3 and the top surface 7 of the gas pump 1. The audio and video housing 3 may contain two displays 9. In other exemplary embodiments, the audio and video housing 3 may contain any number of displays 9. The displays 9 may be CRT, LED, LCD, OLED, or any other suitable type of display for use in outdoor applications. The displays 9 may be of a type able to withstand a wide range of temperatures and be visible in direct sunlight.

Figure 2:
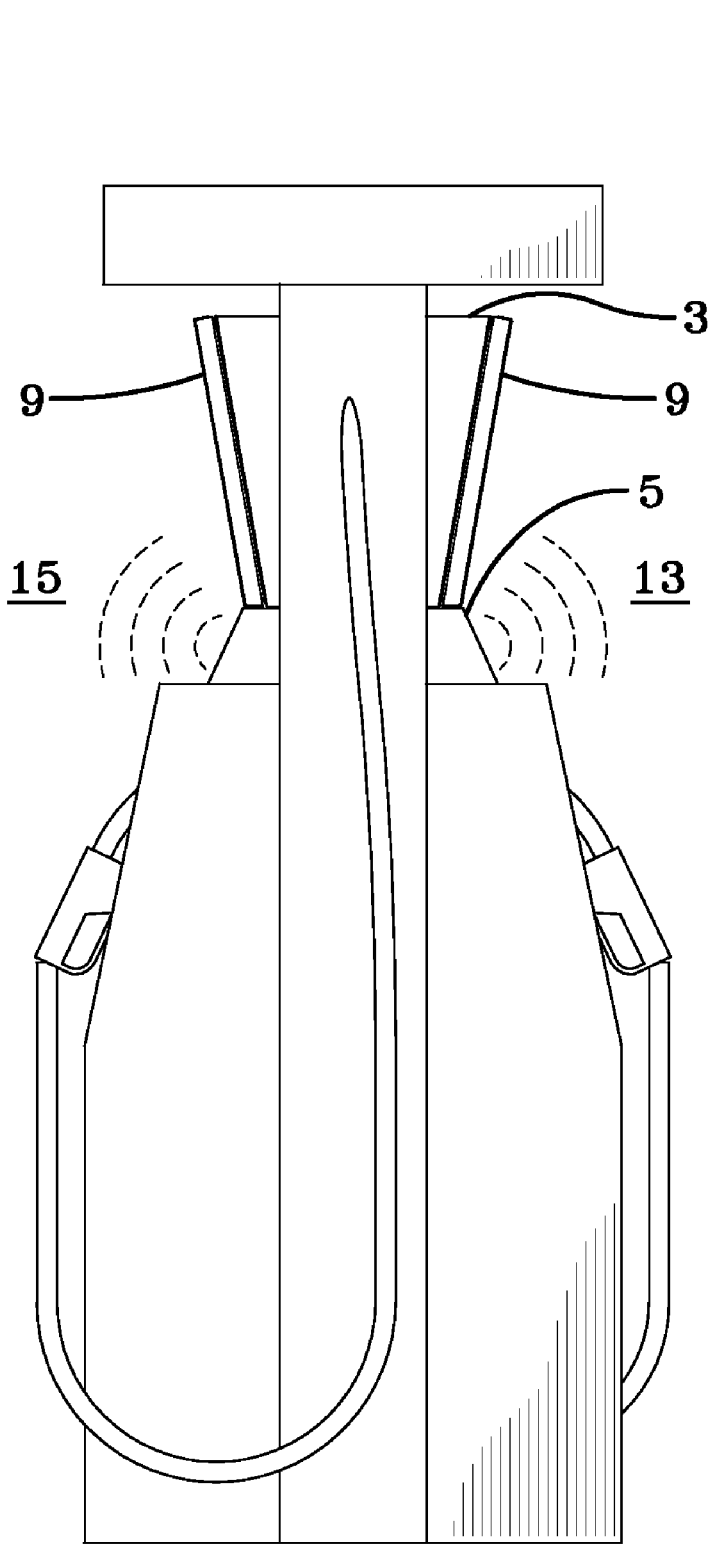
FIG. 2 is a side view of a gas pump having an audio and video housing with an exemplary embodiment of the speaker configuration.

FIG. 2 is a side view of a gas pump 1 having an audio and video housing 3 located on at least one stand 5. The audio and video housing 3 may have two displays 9 facing a first listening area 13 and a second listening area 15. The audio and video housing 3 may have a trapezoidal cross section so the displays 9 are directed downward towards the viewers in both listening areas 13 and 15.

Figure 3:
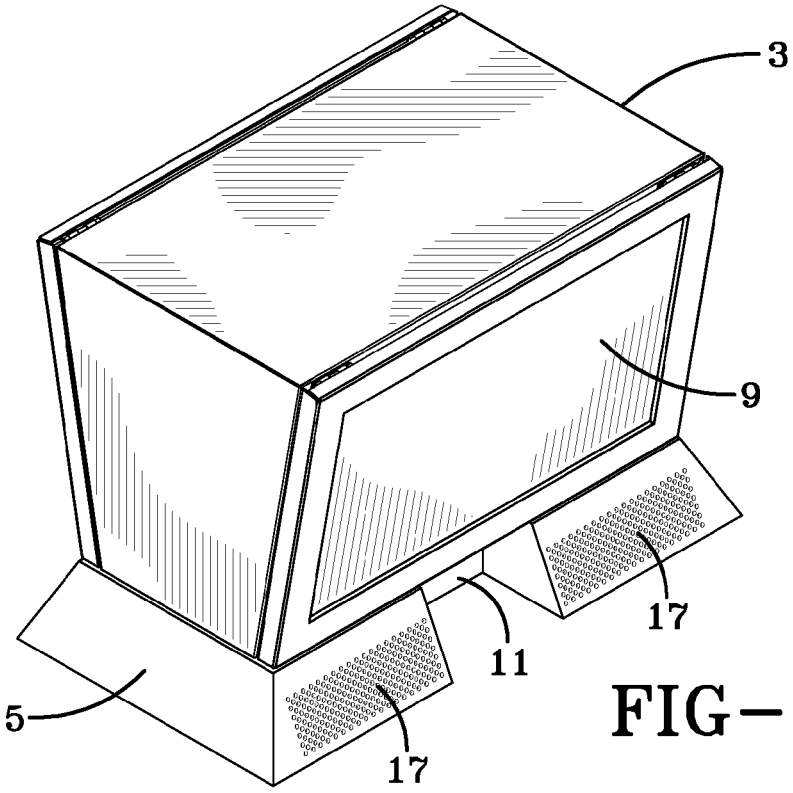
FIG. 3 is a front perspective view of the audio and video housing with an exemplary embodiment of the speaker configuration.

FIG. 3 is a perspective view of an exemplary embodiment of the audio and video housing 3. The audio and video housing 3 may have a trapezoidal design to provide viewers with a more directed angle to the displays 9. The audio and video housing may be supported by at least one stand 5. The at least one stand 5 may have areas of perforation 17 allowing sound waves from the speakers 21 located in the audio and video housing 3 to more easily penetrate the at least one stand 5. The use of the at least one stand 5 may allow for a support 11 between the bottom of the audio and video housing 3 and top surface 7 of the gas pump 1.

Figure 4:
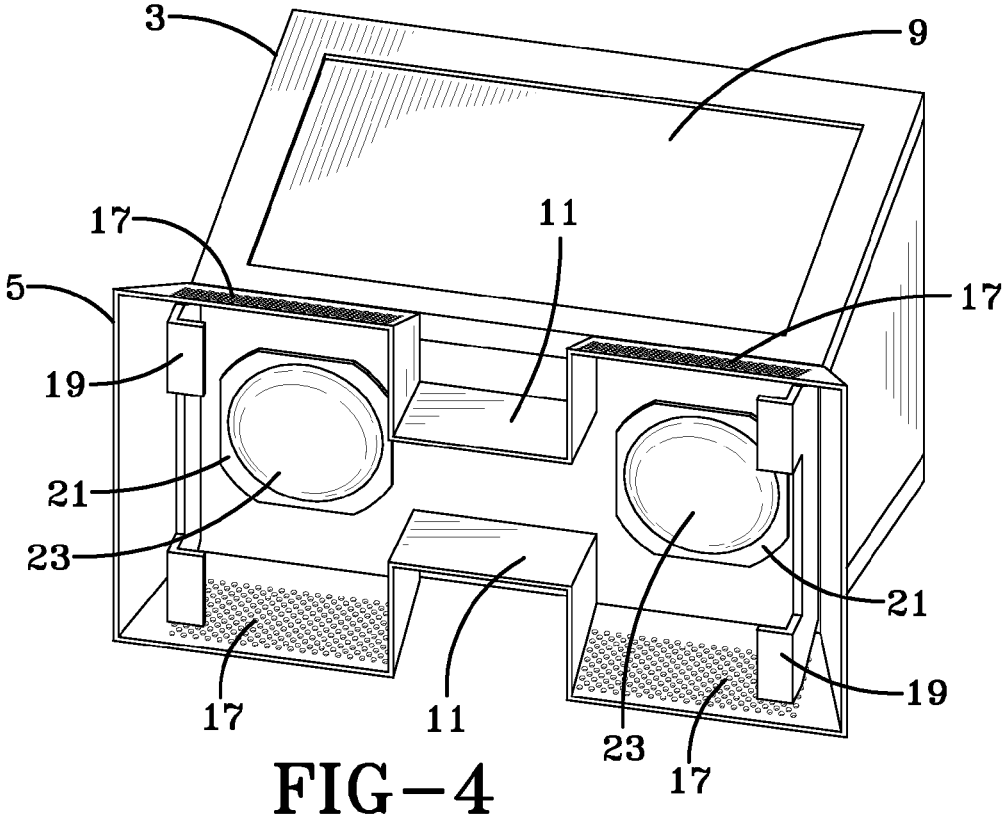
FIG. 4 is a bottom perspective view of the audio and video housing with an exemplary embodiment of the speaker configuration.

FIG. 4 is a bottom perspective view of an exemplary embodiment of the audio and video housing 3. In the exemplary embodiment shown in FIG. 4, the at least one stand 5 may have three sides; each side may have an area of perforation 17. The at least one stand 5 in this exemplary embodiment may have a hollow design. Support structures 19 may be placed in the at least one stand 5 for added strength. A pair of speakers 21 may be located on the bottom of the audio and video housing 3 and may be used to provide stereo sound output from the audio and video housing 3. The speakers 21 may be positioned in the audio and video housing 3 to direct the desired sound downward. In this manner, the desired sound from the speakers 21 may be directed into the top surface 7 of the gas pump 1. The desired sound may be redirected by the top surface 7 of the gas pump 1 and the bottom surface of the audio and video housing 3. As a result of the redirection, the desired sound may pass through the perforated portions 17 to the first and second listening area 13 and 15.

The positioning of the speakers 21 in a downward firing configuration may provide a number of advantages. By directing the sound from the speakers 21 downward towards the top surface 7 of the gas pump 1, stereo sound may be delivered to two listening areas 13 and 15 with a single pair of speakers 21. The downward facing speaker 21 configuration may also prevent moisture from damaging the speakers 21. The downward facing configuration may also prevent moisture from contacting the speakers 21, even if water is directed at the audio and video housing 3. This may allow attendants to clean the audio and video housing 3 without fear of damaging the speakers 21. In other exemplary embodiment, to aid in the prevention of moisture reaching the speakers 21, covers 23 may be placed over the speakers to prevent moisture and foreign particles from damaging the speakers 21. In addition, the downward configuration may allow the use of larger speakers 21 in the audio and video housing 3, as the space inside of the audio and video housing 3 may be limited.

Figure 5:
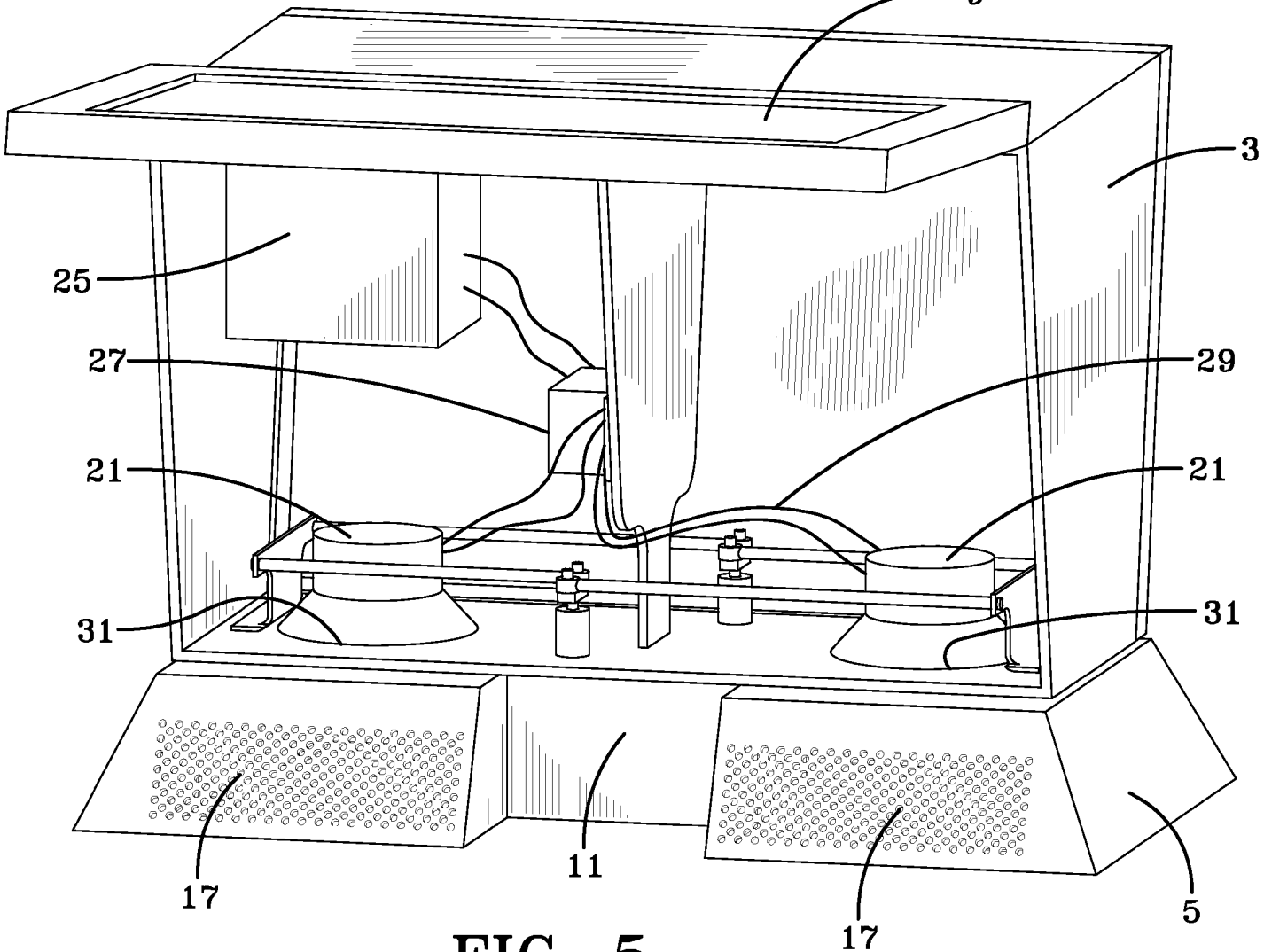
FIG. 5 is an internal view of the audio and video housing with an exemplary embodiment of the speaker configuration.

FIG. 5 is an internal view of the audio and video housing 3. An audio and video source 25 may be provided in the audio and video housing 3. An audio signal may then be sent to an amplifier 27 to power the speakers 21. The audio signal may then pass through circuitry 29 to split the audio signal into two signals. The split signals may then be sent to the speakers 21 to provide stereo sound to the first and second listening areas 13 and 15.

The audio and video housing 3 may have a cutout 31 for each speaker 21. The cone and the coil of each speaker 21 may be passed through a cutout 31 in the bottom of the audio and video housing 3. The use of cutouts 31 may allow substantially all of the speakers' 21 structure to remain inside the audio and video housing 3. This above configuration may protect the cone and coil of the speakers 21 from the elements and foreign particles.

In another exemplary embodiment, the audio and video housing 3 supported by at least one stand 5 may be retrofit to the top of an existing gas pump 1. In other exemplary embodiments, the audio and video housing 3 supported by at least one stand 5 may be constructed as part of a gas pump 1.

While various embodiments of the invention have been described, it will be apparent to those with ordinary skill in the art that many more embodiments and implementations are possible within the scope of the invention. Accordingly, the invention is not to be restricted except in light of the attached claims and their equivalents.

What is claimed is:

1. A method of providing stereo sound associated with an audio and video system adjacent a gasoline pump, comprising the steps of: providing a housing for the video system and a pair of speakers;

providing at least one stand, each at least one stand having a substantially hollow interior; and affixing said at least one stand atop the gasoline pump, such that when the housing is mounted atop the at least one stand, each of the pair of speakers is positioned to direct sound therefrom downwardly into the substantially hollow interior of one of the at least one stand and wherein the at least one stand separates at least partially a portion of the hollow interior under one speaker from the portion of the hollow interior under another speaker.

2. The method of claim 1 further comprising perforating sections of said at least one stand.

3. The method of claim 1, further comprising directing the sound output of the pair of speakers towards a top surface of said gas pump.

4. The method of claim 1, further comprising affixing covers over the pair of speakers.

5. The method of claim 1 wherein the housing has a first and second bottom side.

6. The method of claim 5 further comprising removing a portion of the housing at the first and second bottom sides to receive the pair of speakers.

7. The method of claim 6 further comprising passing the pair of speakers through the removed portion of the housing at the first and second bottom sides respectively so that substantially all of each of the pair of speakers is located inside the housing.

8. A method of providing stereo sound associated with an audio and video system adjacent a gasoline pump, comprising the steps of: providing a housing for the video system and a pair of speakers;

providing first and second stands having perforated sections, each stand having a substantially hollow interior; and affixing the stands atop the gasoline pump, and mounting the housing atop the stands with speakers positioned at its bottom and directing sound downwardly, wherein one speaker directs sound into the hollow interior of the first stand and another speaker directs sound into the hollow interior of the second stand.

9. The method of claim 8 wherein the first and second stands each have a hollow interior.

10. The method of claim 8 wherein substantially all of the first and second speakers are located inside the housing.

11. The method of claim 8 further comprising directing the first and second speakers downward towards the top surface of the gas pump.

12. A housing for providing an audio and video system adjacent a gas pump having a top surface, the housing comprising:

a trapezoidal cross section;

first and second bottom sides; and a first speaker attached at the first bottom side and a second speaker attached at the second bottom side to direct sound downward, respectively, to first and second hollow stands on which the housing is mounted, wherein the stands are affixed to the top surface of the gas pump.

13. The device of claim 12, wherein the first and second stands have a hollow interior.

14. The device of claim 12, wherein the first and second stands have a plurality of perforations.

15. The device of claim 12, wherein substantially all of the first and second speakers are located substantially inside the housing.

16. The device of claim 12, wherein the first and second speakers are positioned to direct sound at the top surface of the gas pump.

17. The device of claim 12, wherein each of the pair of speakers has a covering.

18. The device of claim 12, wherein the stands are affixed to each other by a support.

* * * * *